US011312535B2

(12) United States Patent
Safdie

(10) Patent No.: US 11,312,535 B2
(45) Date of Patent: Apr. 26, 2022

(54) SECURE PACKAGING FOR BOTTLE-TYPE CONTAINERS

(71) Applicant: Best Accessory Group LLC, New York, NY (US)

(72) Inventor: Abraham Safdie, Brooklyn, NY (US)

(73) Assignee: Best Accessory Group LLC, New York, NY (US)

( * ) Notice: Subject to any disclaimer, the term of this patent is extended or adjusted under 35 U.S.C. 154(b) by 0 days.

(21) Appl. No.: 16/799,957

(22) Filed: Feb. 25, 2020

(65) Prior Publication Data

US 2021/0261296 A1 Aug. 26, 2021

(51) Int. Cl.

| | |
|---|---|
| ***B65D 55/06*** | (2006.01) |
| ***B65D 23/08*** | (2006.01) |
| ***B65D 23/00*** | (2006.01) |
| ***B65D 55/16*** | (2006.01) |

(52) U.S. Cl.

CPC ..... *B65D 23/003* (2013.01); *B65D 23/0871* (2013.01); *B65D 55/16* (2013.01); *B65D 55/06* (2013.01); *B65D 2401/05* (2020.05)

(58) Field of Classification Search

CPC ..... B65D 23/0871; B65D 23/0842; B65D 23/085; B65D 23/0864; B65D 23/0878; B65D 2401/05; B65D 2401/00; B65D 55/06; B65D 55/02; B65D 2555/025; B65D 2555/02

See application file for complete search history.

(56) References Cited

U.S. PATENT DOCUMENTS

| | | | | |
|---|---|---|---|---|
| 3,437,194 | A | 4/1969 | Ames et al. | |
| 5,348,180 | A * | 9/1994 | Shepard | B65D 55/06 220/214 |
| 5,938,095 | A | 8/1999 | Haar et al. | |
| 6,206,223 | B1 | 3/2001 | Wicker | |
| 6,892,882 | B1 * | 5/2005 | Powers | B65D 71/46 206/153 |
| 7,878,365 | B1 | 2/2011 | Meehan | |
| 7,926,651 | B2 | 4/2011 | Lindenmayer | |
| D678,729 | S | 3/2013 | Peeters | |
| D776,487 | S | 1/2017 | Peeters | |
| 2008/0128421 | A1 | 6/2008 | Ulbrand | |
| 2011/0259846 | A1 | 10/2011 | Diegel | |

(Continued)

FOREIGN PATENT DOCUMENTS

WO WO-2005057357 A2 * 6/2005 ..... B65D 21/0228

*Primary Examiner* — Allan D Stevens

(74) *Attorney, Agent, or Firm* — Dorton & Willis, LLP

(57) ABSTRACT

A secure packaging for bottle-type containers having a body, a neck terminating in an opening into an interior of the bottle, and a cap for sealing the opening. The packaging may include a flexible casing having an interior cavity for receiving the bottle body, and a first aperture configured to admit the bottle body into the cavity. A second aperture is configured to receive the neck of the bottle, such that the bottle opening protrudes from the casing when the bottle body is received in the cavity. A first tether may be configured to facilitate releasably securing the casing to an object. A second tether is operatively coupled between the casing and the aperture on the bottle cap. The second tether is configured to secure the cap with the casing and to be frangibly removed from the casing prior to use of the bottle to dispense contents of the bottle.

6 Claims, 3 Drawing Sheets

(56) References Cited

U.S. PATENT DOCUMENTS

| | | | | |
|---|---|---|---|---|
| 2016/0001925 | A1* | 1/2016 | Frazier | B65D 23/003 215/395 |
| 2017/0015459 | A1* | 1/2017 | Warner | B65D 55/06 |

* cited by examiner

SECURE PACKAGING FOR BOTTLE-TYPE CONTAINERS

TECHNICAL FIELD

The present invention relates generally to packaging for retail products and, more particularly, to a secure packaging for bottle-type containers.

BACKGROUND

Fluid products such as hand sanitizers, lotions, or other liquids are often provided in small, personal use-sized containers that are convenient for travel or for carrying on-the-go to provide quick access for use as needed. Some bottles are provided with a container or casing to facilitate carrying the bottle, or for attachment of the bottle to other objects, such as backpacks, purses, strollers, etc. One drawback of such personal use-sized containers provided in a casing is that, in retail display settings, the generally loose fitting of the casing enables unauthorized removal from the casing, resulting in loss of product to the retailers and frustration to prospective purchasers whose selection is thereby reduced or eliminated. Accordingly, there is a need for a simple way to secure such personal use-sized containers prior to the purchase and subsequent use of the product.

SUMMARY

The present invention provides a secure packaging for bottle-type containers that include a body, a neck terminating in an opening into an interior of the bottle, and a cap having an aperture adapted for receiving a tether. In one aspect, the packaging includes a flexible casing having an interior cavity configured to receive the bottle body. A first aperture in the casing is configured to admit the bottle body into the cavity, and a second aperture is configured to receive the neck of the bottle therethrough, such that the opening of the bottle protrudes from the casing when the bottle body is received in the cavity. The casing may further include a first tether configured to facilitate securing the casing to an object.

In another aspect, the first tether is adjustable between a closed condition that secures the casing to an object, and an open condition for releasing the casing from the object. The secure packaging further includes a second tether operatively coupled between the casing and the aperture on the bottle cap. The second tether is configured to secure the cap with the casing and to be frangibly removed from the casing prior to use of the bottle to dispense contents of the bottle.

The above and other objects and advantages of a packaging in accordance with the present disclosure shall be made apparent from the accompanying drawings and the description thereof.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
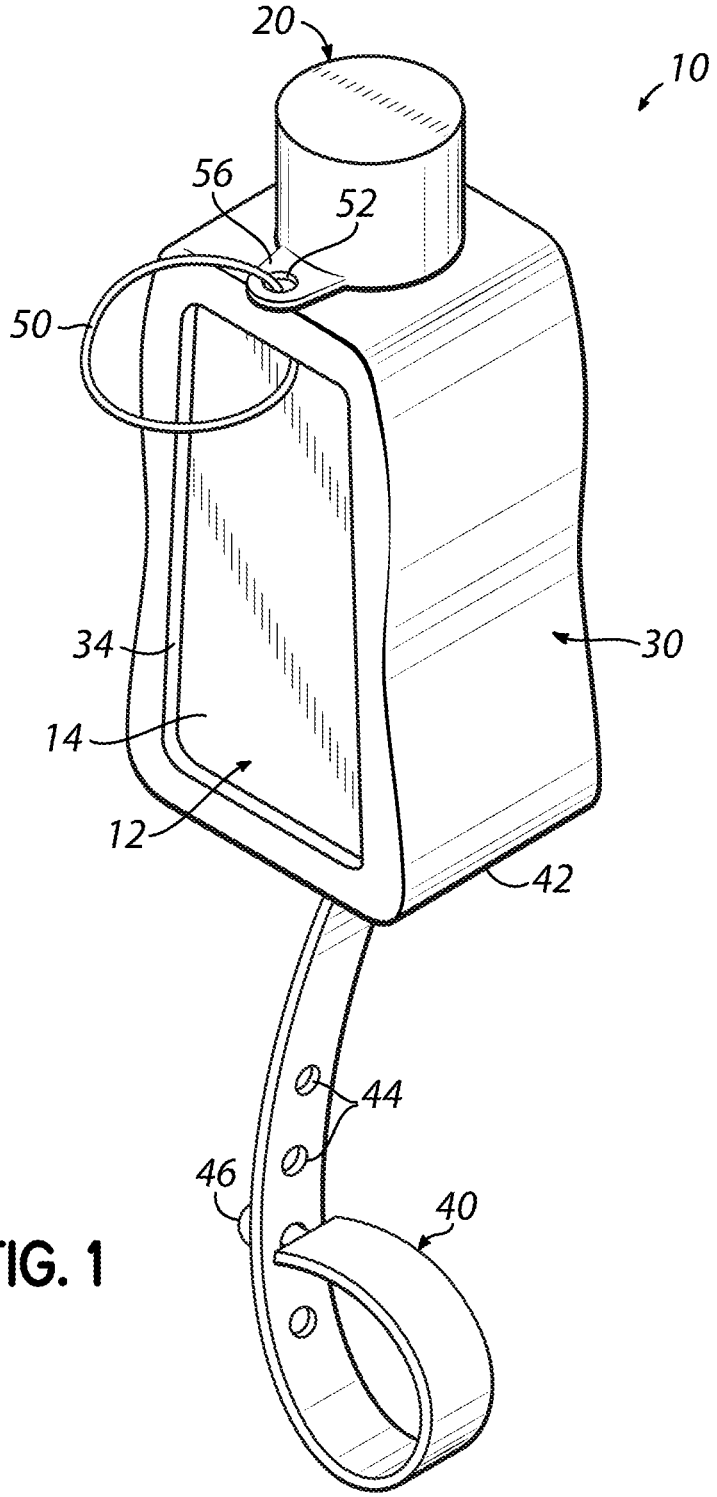
FIG. 1 is a perspective view of an exemplary packaging for bottle-type containers in accordance with the principals of the present invention.
Figure 2:
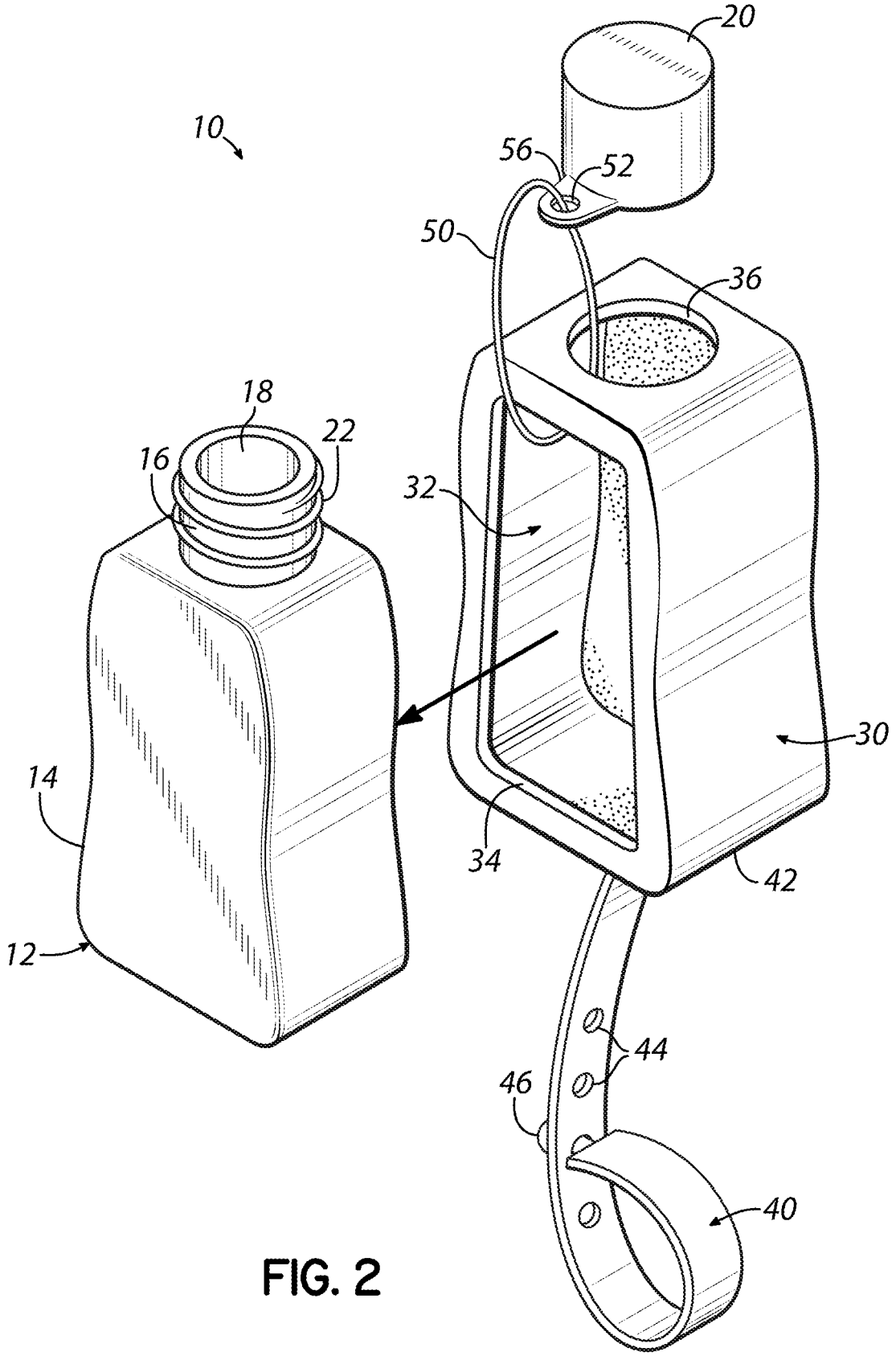
FIG. 2 is an exploded view of the packaging of FIG. 1.
Figure 3:
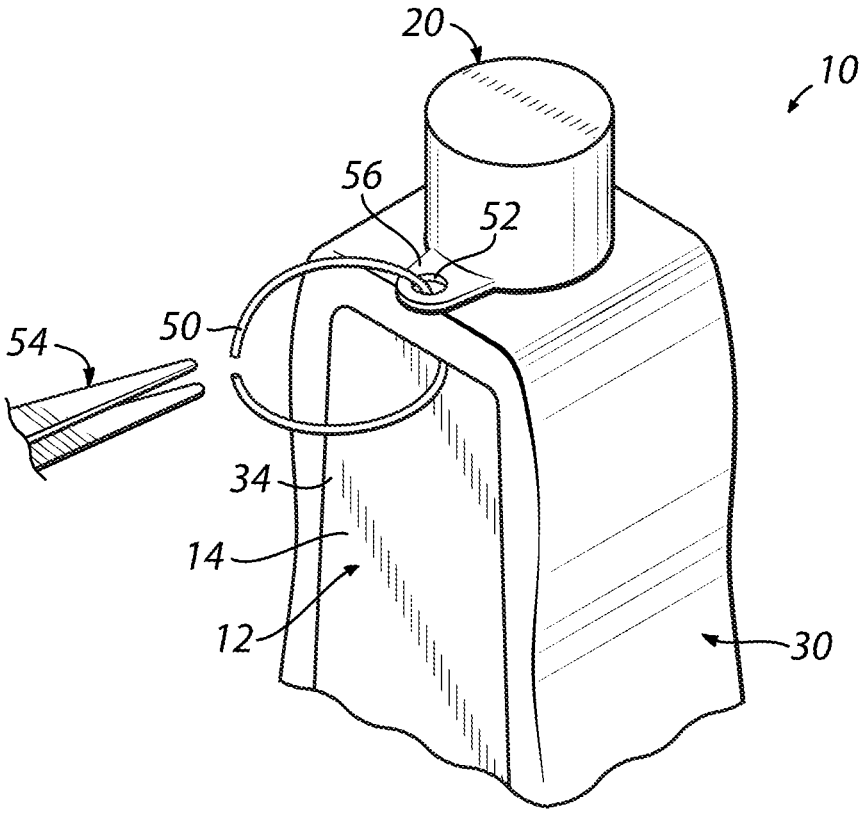
FIG. 3 illustrates an exemplary use of the packaging of FIG. 1.

FIGS. 1 and 2 depict an exemplary packaging 10 for use with bottle-type containers 12 and which provides security for the packaged container 12 prior to purchase and use. Typical bottle-type containers 12 include a bottle body 14 defining an interior chamber for storing contents such as liquids or other materials. A neck 16 projects outwardly from the bottle body 14 and terminates in an opening 18 into the interior chamber of the bottle body 14. The container 12 is also provided with a cap 20 configured to be received onto the neck 16 to provide a closure for the opening 18. The neck may include screw threads 22 or other structure to facilitate coupling the cap 20 with the neck to seal the opening 18.

In the embodiment shown, the packaging 10 further includes a casing 30 configured to generally surround the bottle body 14 and thereby capture the container 12 therein. To this end, the casing 30 includes an internal cavity 32 configured to receive the bottle body 14. A first aperture 34 in the casing 30 is sized to admit the bottle body 14 into the cavity 32. The casing 30 may be made from a flexible, resilient material whereby the casing 30 may be stretched and/or deformed to facilitate receiving the bottle body 14 into the cavity 32 through the first aperture 34. After the bottle body 14 has been received into the cavity 32, the resilient material of the casing 30 allows the casing 30 to substantially return to its original undeformed shape. The casing 30 may further include a second aperture 36 sized and configured to receive the neck 16 of the container 12 therethrough, such that the opening 18 of the container 12 protrudes from the casing 30 when the bottle body 14 is received in the cavity 32.

With continued reference to FIGS. 1 and 2, the casing 30 further includes a first tether 40 configured to facilitate securing the casing 30 to an object. In the embodiment shown, the first tether 40 is in the form of an elongate band extending from a distal end 42 of the casing 30, generally opposite the second aperture 36. It will be appreciated, however, that the first tether 40 may alternatively have various other forms, and may be located on various other portions of the casing 30. While a single first tether 40 is shown and described herein, it will be appreciated that more than one first tether 40 may alternatively be provided to facilitate securing the casing 30 to an object or to facilitate carrying the casing 30, which in turn supports a container 12 therein. The first tether 40 may also be selectively adjustable between a closed condition that facilitates securing the casing 30 to an object, and an open position for releasing the casing 30 from the object. In the embodiment shown, the first tether 40 includes one or more holes 44 disposed along the axial length of the band, and a shaped, distal end 46 configured to be larger in size than the one or more holes 44. When the first tether 40 is formed from a flexible, resilient material, such as the same material as the casing 30, the shaped distal end 46 of the first tether 40 may be pushed through one of the holes 44 to define a closed loop suitable for attaching the first tether 40 to an object in a closed condition of the first tether 40. Thereafter, when it is desired to remove the casing 30 from the object, the shaped distal end 46 of the first tether 40 may be withdrawn from the hole 44 to place the first tether 40 in an open condition suitable for releasing the casing 30 from the object. While the adjustability of the first tether 40 has been shown and described herein as being facilitated by a shaped distal end 46 and one or more holes 44 that cooperate with the shaped distal end 46 to adjust the first tether 40 between open and closed conditions, it will be appreciated that various other methods for facilitating selective adjustability between closed and open conditions of the first tether 40 may alternatively be used.

The exemplary packaging 10 further includes a second tether 50 operatively coupled between the casing 30 and an aperture 52 provided on the cap 20 of a container 12 that has been received within the interior cavity 32 of the casing 30 to thereby secure the cap 20 and the container 12 to the casing 30. In the coupled condition of the second tether 50, the cap 20 and container 12 are secured to the casing 30 prior to the authorized purchase and use of the packaged container 12 to dispense contents of the container 12, for example in a retail display setting. The second tether 50 is further configured to be frangibly removed from the casing 30 prior to use of the container 12 to dispense its contents. As used herein, "frangible" means that the second tether 50 is not easily broken, such as by hand-pulling or other manual manipulation of the second tether 50. Rather the second tether 50 must be broken such as by using a cutting tool 54 such as scissors or a knife, for example. As such, the frangible second tether 50 is configured to retain the cap 20 and container 12 together with the casing 30 until the entire product is validly purchased and ready for use, whereafter the second tether 50 may be broken to facilitate separation of the cap 20 from the neck 16 of the container 12 and/or casing 30.

In the embodiment shown, the cap 20 of the container 12 includes a tab 56 extending radially outwardly from the cap 20, and the aperture 52 is provided through the tab 56. The aperture 52 through the tab 56 is sized and configured to receive the second tether 50 whereby the casing 30 and cap 20 may be secured by the second tether 50 as described above. While the embodiment shown and described herein includes a tab 56 provided on the cap 20 of the container 12, it will be appreciated that the second tether 50 may alternatively be coupled with the cap 20 by various other methods and/or structure. As a non-limiting example, the second tether 50 may alternatively be integrated with a portion of the cap 20, and may be configured to facilitate a one-time locking of the second tether 50 onto the casing 30. After the integrated second tether 50 has been locked onto the casing 30, it must thereafter be frangibly removed to facilitate use of the container 12 to dispense its contents.

In use, a bottle-type container 12 may be secured by obtaining a packaging 10 that includes a flexible casing 30 having an interior cavity 32 configured to receive the bottle body 14 as described above, and coupling the cap 20 of the container 12 to the casing 30 with a second tether 50, wherein the second tether 50 is configured to be frangibly removed from the casing 30 prior to use of the container 12 to dispense its contents. When the bottle-type container 12 includes a cap 20 having an aperture 52 adapted to receive a tether, the method may further include coupling the cap 20 of the container 12 to the casing 30 by passing the second tether 50 through the aperture 52 in the cap 20.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A secure packaging for bottles wherein the bottle includes a body, a neck terminating in an opening into an interior of the bottle, and a cap having an aperture adapted for receiving a tether, the packaging comprising:

a flexible casing, the casing having an interior cavity configured to receive the bottle body, a first aperture configured to admit the bottle body into the cavity, and a second aperture configured to receive the neck of the bottle therethrough such that the opening of the bottle is positioned outside the cavity when the bottle body is received in the cavity and the neck is received though the second aperture;

a first tether coupled with the casing and configured to facilitate securing the casing to an object; and a second tether passing through the first and second apertures, the second tether configured to be operatively coupled between the casing and the aperture on the bottle cap, the second tether configured to secure the cap with the casing and to be frangibly removed from the casing prior to use of the bottle to dispense contents of the bottle.

2. The packaging of claim 1, wherein the first tether is selectively adjustable between a closed condition adapted to secure the casing to an object, and an open condition adapted for releasing the casing from the object.

3. The packaging of claim 1, wherein the casing comprises elastomeric material.

4. A secure packaging in combination with a bottle wherein the bottle includes a body, a neck terminating in an opening into an interior of the bottle, and a cap having an aperture adapted for receiving a tether, the packaging comprising:

a flexible casing, the casing having an interior cavity configured to receive the bottle body, a first aperture configured to admit the bottle body into the cavity, and a second aperture configured to receive the neck of the bottle therethrough such that the opening of the bottle is positioned outside the cavity when the bottle body is received in the cavity and the neck is received though the second aperture;

a first tether coupled with the casing and configured to facilitate securing the casing to an object;

the bottle disposed in the cavity; and a second tether passing through the first and second apertures, the second tether operatively coupled between the casing and the aperture on the bottle cap, the second tether configured to secure the cap with the casing and to be frangibly removed from the casing prior to use of the bottle to dispense contents of the bottle.

5. The packaging of claim 4, wherein the bottle cap includes an outwardly extending tab, and the aperture for receiving the second tether is located on the tab.

6. A method for securing a bottle, the method comprising:

obtaining a packaging comprising:

the bottle including a body, a neck terminating in an opening into an interior of the bottle, and a cap received over the neck, a flexible casing at least partially surrounding the bottle body, the casing having an interior cavity configured to receive the bottle body, a first aperture configured to admit the bottle body into the cavity, and a second aperture configured to receive a neck of the bottle therethrough such that the opening of the bottle is positioned outside the cavity when the bottle body is received in the cavity and the neck is received though the second aperture, and a first tether coupled with the casing and configured to facilitate securing the casing to an object; and coupling the cap of the bottle to the casing with a second tether passing through the first and second apertures, wherein coupling the cap of the bottle to the casing comprises passing the second tether through an aperture in the cap, the second tether configured to be frangibly removed from the casing prior to use of the bottle to dispense contents of the bottle.

* * * * *